United States Patent [19]

Birkes et al.

[11] Patent Number: 4,601,924

[45] Date of Patent: Jul. 22, 1986

[54] SPECIAL LIGHT EFFECT VISUAL ORNAMENTS

[75] Inventors: Stephen Birkes, Levasy; Donna L. Hill, Independence, both of Mo.; Kurt Pfahl, Leawood, Kans.

[73] Assignee: Hallmark Cards, Inc., Kansas City, Mo.

[21] Appl. No.: 660,915

[22] Filed: Oct. 15, 1984

[51] Int. Cl.[4] ..... A47G 33/08

[52] U.S. Cl. ..... 428/7; 40/442; 362/806; 428/13; 446/477

[58] Field of Search ..... 428/7, 13; 40/442, 443; 362/806; 446/476, 477

[56] References Cited

U.S. PATENT DOCUMENTS

| | | | |
|---|---|---|---|
| 2,232,110 | 2/1941 | Gruenhut | 40/442 X |
| 2,500,899 | 3/1950 | Leahan | 428/7 X |
| 2,544,034 | 3/1951 | Levering | 446/477 |
| 3,035,162 | 5/1962 | Emmich | 428/11 X |
| 3,124,856 | 3/1964 | Fleminger | 428/7 X |
| 3,294,397 | 12/1966 | Durand, III | 428/7 X |
| 3,940,521 | 2/1976 | Hack | 428/7 |
| 4,236,335 | 12/1980 | Colonneau | 40/442 |
| 4,462,066 | 7/1984 | Gibson et al. | 362/806 X |
| 4,517,040 | 5/1985 | Whitted | 428/7 X |

*Primary Examiner*—Henry F. Epstein

*Attorney, Agent, or Firm*—Neuman, Williams, Anderson & Olson

[57] ABSTRACT

A tree ornament is disclosed in which a plurality of images are produced by two-dimensional image formations or three-dimensional objects, with a plurality of lights being energized in timed relation to selectively present the images to view through a window, and with reflecting and transmitting surfaces being used to allow energization of the lights to replace one image with another and/or to superimpose images.

22 Claims, 5 Drawing Figures

FIG. 1
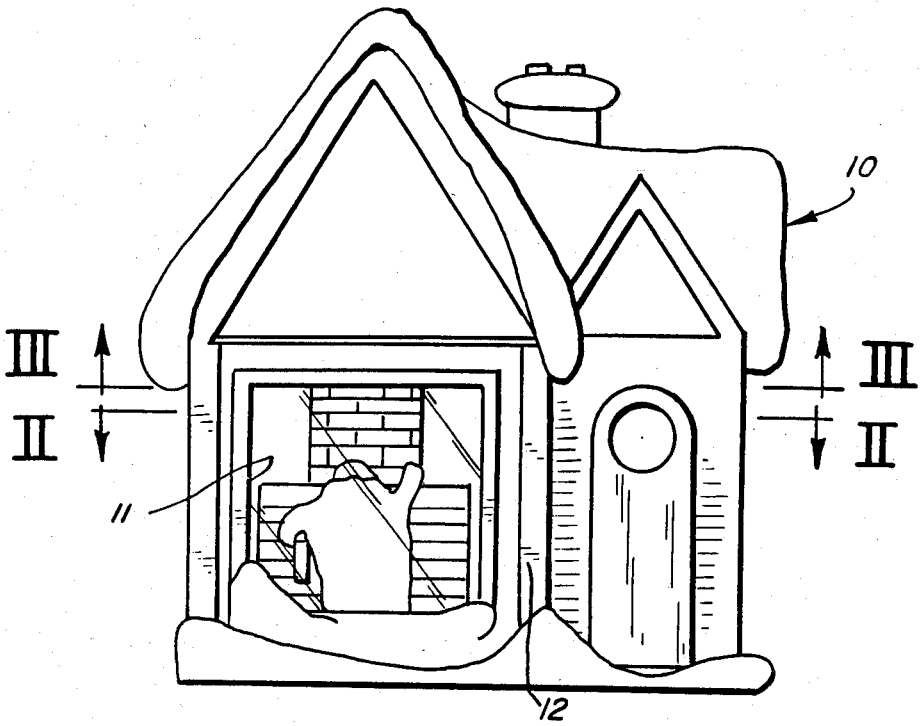
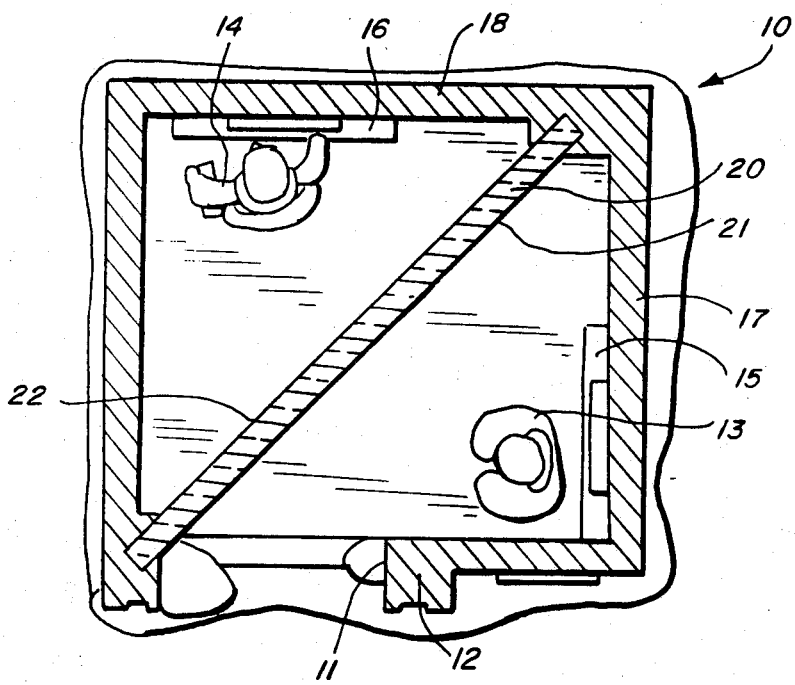
FIG. 2

FIG. 3
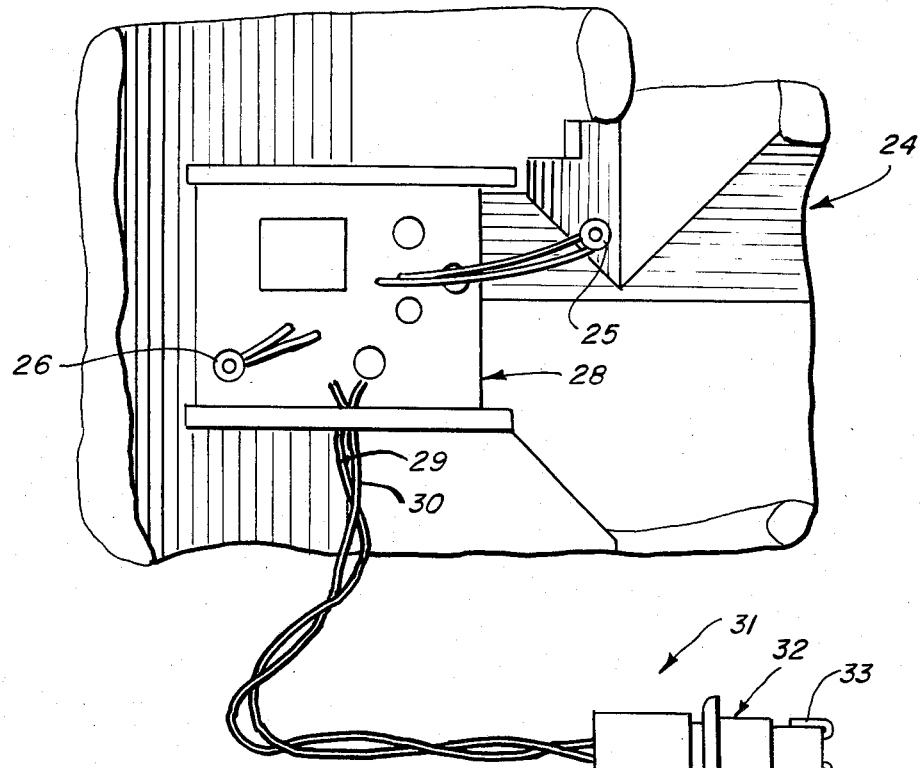
FIG. 4
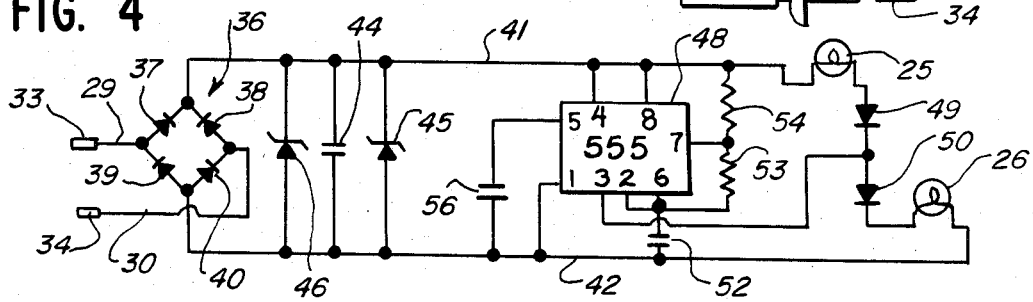
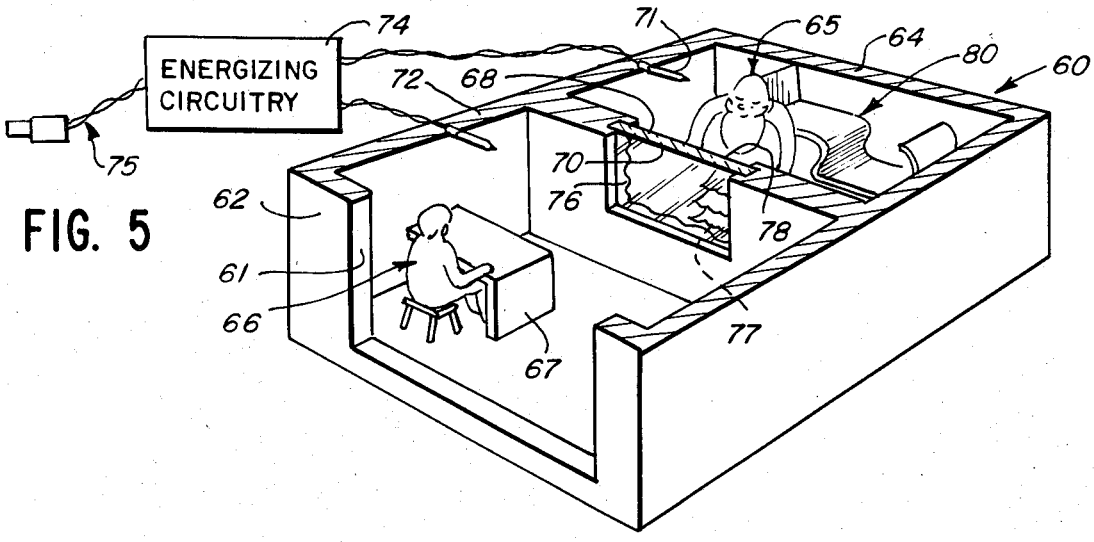
FIG. 5

SPECIAL LIGHT EFFECT VISUAL ORNAMENTS

This invention relates to ornaments such as ornaments arranged for hanging on trees and more particularly to ornaments which are operable to present plural image visual effects in a highly attractive manner. The ornaments of the invention are operable to present various types of images in sequence to simulate motion and/or to attract attention and are otherwise very versatile while being readily constructed and operated and being durable and reliable and economically manufacturable.

BACKGROUND OF THE INVENTION

Many types of ornaments have heretofore been provided for hanging on Christmas trees or the like or for other similar uses and although the ornaments have been operable to produce a great many interesting and attractive effects, there has still been room for improvement, both with respect to the types of effects to be produced and with respect to the construction of ornaments to obtain better performance and reliability and to facilitate economic manufacture of the ornaments.

SUMMARY OF THE INVENTION

This invention was evolved with the general object of providing ornaments which produce more attractive and otherwise improved visual effects while being very convenient to use and while being readily and economically manufacturable.

In accordance with the invention, ornaments are provided which include new presentation means operable in a plurality of modes to present plural object means to view. In one type of ornament constructed in accordance with the invention, first and second object means are provided within an enclosure, each object means including either a three-dimensional solid object or a two dimensional image formation. In one embodiment, images of two miniature Santa Claus figures are alternately presented to view through a "picture" window of a miniature house with the images of the figures being presented in about the same position but striking different postures to produce the illusion of motion.

To present the images in about the same position, a reflecting surface is positioned to permit viewing of an image of one figure after reflection from the surface and the surface is also positioned between the window and the other figure and is operative to transmit light therethrough to present an image of the other figure without reflection.

Important features of the invention relate to the attainment of a plurality of modes of operation through the use of one or more lamps which are energized at predetermined times during each cycle of operation of a control means. In the aformentioned embodiment having two Santa Claus figures, two lamps are positioned over the figures within the miniature house, and a circuit is provided to effect alternate energization of the two lamps. Preferably, the circuit is mounted within the miniature house or other enclosure of the ornament and it includes solid state components with a full wave bridge rectifier, arranged for connection through a pig-tail connector to a string of conventional holiday lights.

The invention contemplates other objects, features and advantages which will become more fully apparent from the following detailed description taken in conjunction with the accompanying drawings.

BRIEF DESCRIPTION OF THE DRAWINGS

FIG. 1 is a front elevational view of a miniature house ornament constructed in accordance with the invention;

FIG. 2 is a sectional view taken substantially along line II—II of FIG. 1 and providing a floor plan view;

FIG. 3 is a sectional view taken substantially along line III—III of FIG. 1 and looking upwardly to provide a bottom plan view of roof structure of the ornament;

FIG. 4 is a schematic diagram of electrical circuitry of the ornament; and

FIG. 5 is a diagrammatic perspective view of a modified arrangement.

DESCRIPTION OF PREFERRED EMBODIMENTS

Reference numeral 10 generally designates an ornament constructed in accordance with the principles of the invention. The illustrated ornament 10 is in the form of a miniature house which has an opening forming a "picture" window 11 in a front wall portion 12 thereof. Two miniature Santa Claus figures 13 and 14 are positioned within the miniature house ornament 10, in front of two hearths 15 and 16. Hearth 15 is positioned against a side wall portion 17 of the ornament and hearth 16 is positioned against a rear wall portion 18. Figure 13 together with the hearth 15 and decorative material on the internal surface portion of the side wall portion 17 form object means which may be viewed in one mode of operation while figure 14 together with hearth 16 and decorative material on on the inside surface of the rear wall portion 18 form another object means which may be viewed in another mode of operation.

A member 20 is disposed within the ornament 10 within the ornament and behind the window 11 and it forms part of means for presenting the two object means to view through the window 11. Member 20 has a front surface 21 which is reflective and which is positioned to reflect an image of the figure 13 to view through the window 11. The member 20 is of a transparent material and is positioned between the window and the figure 14 with both the front surface 21 and a rear surface 22 thereof being light transmitting surfaces, to permit viewing of the figure 14 through the window 11.

FIG. 3 is a sectional view, looking upwardly at the underside of roof structure 24 of the ornament 10. Two lamps 25 and 26 are provided, lamp 25 being positioned over the Santa Claus figure 13 and lamp 26 being positioned over the Santa Claus figure 14. The lamps 25 and 26 are connected to a circuit board 28 which is connected to ends of two wires 29 and 30 of a "pig-tail" connector 31. The wires extend out through the rear wall of the ornament and the opposite ends thereof are connected to a plug 32 which is arranged to be inserted into a socket of a conventional string of holiday lights and which includes conductors 33 and 34 connected to the wires 29 and 30.

When connected in a string of lights which is connected to a standard AC voltage source, the lamps 25 and 26 are alternately energized to illuminate the Santa Claus figures 13 and 14 and associated hearths 15 and 16 and to cause alternate viewing of images thereof through the window 11. In the absence of illumination, the regions within the ornament are relatively dark, so that each figure is seen only when the associated lamp is energized. In the illustrated arrangement, the two figures 13 and 14 have different postural states and the appearance of motion is obtained. As shown, the figure 13 faces away from the hearth 15, and toward the member 20 while the figure 14 faces toward the hearth 16 and away from the member 20.

The member 20 is desirably such that light is only partially reflected and only partially transmitted at the surface 21. Members of coated Mylar and other materials have been tried. It has been found, however, that excellent results are obtained using a member 20 of ordinary glass with no special coating.

FIG. 4 is a schematic diagram of circuitry of the board 28. A bridge rectifier 36 is provided which includes four diodes 37–40 and which has input terminals connected through the wires 29 and 30 to the conductors 33 and 34 of the plug 32. Output terminals of the rectifier 36 are connected to plus and minus output lines 41 and 42 and a filter capacitor 44 and two Zener diodes 45 and 46 are connected in parallel with each other and between the lines 41 and 42. The diodes 45 and 46 have different voltage ratings. For example, the diode 45 may have a voltage rating of 12 volts while the diode 46 may have a voltage rating of 15 volts. In normal operation the diode 45 with the lower rating operates to limit the voltage between the lines 41 and 42 and to insure that there is a path for current conduction and energization of lights of the string to which the ornament is connected. Diode 46 operates as a back-up to prevent excessive voltage and to provide a current path in the event of partial or complete failure of the diode 45 and/or under transient voltage surge conditions.

To energize the lamps 25 and 26, a Type 555 integrated circuit 48 is provided which has an output pin 3 connected to the cathode of a diode 49 and to the anode of a diode 50 with the anode of diode 49 being connected through the lamp 25 to the line 41 with the cathode of diode 50 being connected through the lamp 50 to the line 42. A trigger pin 2 and a threshold pin 6 of the circuit 48 are connected through a capacitor 52 to the line 42 and also through a resistor 53 to a discharge pin 7 which is connected through a resistor 54 to the line 41. A control voltage pin 5 is connected through a capacitor 56 to line 41; pin 1 is connected directly to line 42 and pins 4 and 8 are connected directly to line 41.

With the connections as shown, the circuit 48 operates as a free-running circuit to generate a square wave at the output pin 3, energizing the lamp 25 when the pin 3 is low and energizing the lamp 26 when the pin 3 is high.

By way of example, the resistors 53 and 54 may have values of 1.5 megohms and 33 kilo-ohms and the capacitors 52 and 56 may have values of 10 microfarads and 0.1 microfarads, respectively. The operating frequency may be on the order of 0.05 Hz.

FIG. 5 is a diagrammatic perspective view of a modified arrangement in which a miniature house ornament 60 includes a window 61 in a front wall 62 and in which a wall 63 is provided intermediate the front wall 62 and a rear wall 64. A miniature Santa Claus figure 65 is positioned between the intermediate wall 63 and the rear wall 64 and a miniature boy figure 66 is positioned between the front wall 62 and the intermediate wall 63, the boy figure 66 being positioned adjacent a miniature desk 67.

A member 68 is positioned in an opening 69 of the intermediate wall 64 and it has a surface 70 which is reflective and which appears as either a mirror or a window, depending upon the illumination of the space in which the Santa Claus figure 65 is disposed. As illustrated in lamp 71 is positioned over the Santa Claus figure 65 and a lamp 72 is positioned over the boy figure 66, lamps 71 and 72 being connected to circuitry 74 which is connectable through a pig-tail connector 75 to a string of lights.

In the arrangement of FIG. 5, the lamp 71 may preferably be periodically energized while the lamp 72 may be continuously energized.

Two-dimensional images may be provided on surfaces of light-reflecting/light-transmitting surfaces. As shown in FIG. 5, a frame design 76 may be disposed on the front surface 70 of the member 68 to be illuminated from the front when the lamp 72 is energized and to be illuminated from the rear when the lamp 71 is energized. A tree design 77 may be disposed on a rear surface 78 of the member 68 to be illuminated from the rear when the lamp 71 is energized. Also, a two-dimensional sleigh design 80 may be provided on the front surface of the rear wall 64, behind the Santa Claus figure 65. Such two-dimensional images enhance the three-dimensional effects which are obtained from the relative spacial positions of plural object means, and otherwise increase the attractiveness of the visual effects which are produced.

It will be understood that modifications and variations may be effected without departing from the spirit and scope of the novel concepts of the invention.

We claim:

1. A self-contained portable tree ornament or the like, comprising: a miniature enclosure of a size which permits hanging on a Christmas tree and including a wall portion having a window therein, first and second object means within said enclosure, and view presentation means within said miniature enclosure for operation in a first mode to present a first scene with only said first object means in view through said window and for operation in a second mode to present a second scene with said second object means in view through said window, said view presentation means being operable in repetitive cycles with said first and second scenes being sequentially presented to view through said window during each cycle.

2. In an ornament as defined in claim 1, said second mode of operation being such that only said second object means are presented for viewing thereof through said window.

3. In an ornament as defined in claim 1, said second mode of operation being such that said first object means are presented for viewing thereof in superimposed relation to said second object means.

4. In an ornament as defined in claim 3, said view presentation means being operable in a third mode to present only said second object means for viewing thereof through said window.

5. In an ornament as defined in claim 1, said view presentation means including a reflecting surface disposed in rearwardly spaced relation to said front wall portion and so positioned in relation to said first object means as to permit viewing of said first object means through said window after reflection from said reflecting surface.

6. In an ornament as defined in claim 1, said view presentation means including a partially transmitting surface positioned between said window and said second object means.

7. In an ornament as defined in claim 5, said reflecting surface being positioned between said window and said second object means and being a partially transmitting surface for operation in said second mode to permit viewing of said second object means through said window.

8. In an ornament as defined in claim 6, said first object means including an image on said partially transmitting surface.

9. In an ornament as defined in claim 6, said second object means including an image on said partially transmitting surface.

10. In an ornament as defined in claim 1, at least one of said object means including a three-dimensional solid object.

11. In an ornament as defined in claim 1, at least one of said object means including a two-dimensional image formation.

12. In an ornament as defined in claim 11, said view presentation means including a reflecting surface carrying said two-dimensional image formation thereon.

13. In an ornament as defined in claim 12, said reflecting surface being so positioned relative to said second object means as to permit viewing through said window of an image of said second object means reflected from said reflecting surface.

14. In an ornament as defined in claim 1, said view presentation means including illumination means operable in said second mode to illuminate said second object means.

15. In an ornament as defined in claim 14, said view presentation means comprising illumination means operable in said first mode to illuminate said first object means.

16. In an ornament as defined in claim 1, said view presentation means comprising cyclically operable electrical control means arranged for effecting operation in said first mode during one portion of each operating cycle thereof.

17. In an ornament as defined in claim 16, said electrical control means being arranged for effecting operation in said second mode during a portion of each cycle of operation different from said one portion.

18. In an ornament as defined in claim 1, said view presentation means comprising first and second electrically operable illumination means positioned to respectively illuminate said first and second object means and to obtain said first and second modes of operation.

19. In an ornament as defined in claim 1, said wall portion being a front wall portion of said miniature enclosure, said enclosure including a rear wall portion and an intermediate wall portion between said front and rear wall portions with said intermediate wall portion having a window therein forming part of said view presentation means and located in generally registering relation to said window of said front wall portion, said first object means being located in a first space between said front wall portion and said intermediate wall portion and said second object means being located in a second space between said intermediate wall portion and said rear wall portion.

20. In an ornament as defined in claim 19, first lamp means for illuminating said first space, and second lamp means for illuminating said second space.

21. In an ornament as defined in claim 7, said wall portion being a vertical wall portion, said first and second object means being at substantially the same vertical level as said window, and said reflecting and partially transmitting surface being substantially vertical.

22. In an ornament as defined in claim 21, said view presentation means further comprising first and second electrically energizeable lamp means for illuminating said first and second object means to obtain first and second modes of operation, and cyclically operable control means arranged for energizing said first lamp means during a first portion of each operating cycle and second lamp means during a second portion of said operating cycle.

* * * * *